US005428843A

United States Patent [19]

Clowers et al.

[11] Patent Number: 5,428,843

[45] Date of Patent: Jul. 4, 1995

[54] ADJUSTABLE CAP, METHOD AND SYSTEM FOR SIZING CAPS

[76] Inventors: J. Michael Clowers, #12 Pegues Pl., Longview, Tex. 75601; L. Don Hutson, Rte. #2, Box 326B, Longview, Tex. 75601; Steven J. Morose, 1798 Golden Lake Ct., Chesterfield, Mo. 63017

[21] Appl. No.: 84,567

[22] Filed: Jun. 29, 1993

[51] Int. Cl.[6] ..... A42B 1/22

[52] U.S. Cl. ..... 2/195.2; 2/183; 2/195.3

[58] Field of Search ..... 2/171, 181, 183, 184, 2/195.1, 195.2, 195.3, 195.4, 417, 418, 420, DIG. 11

[56] References Cited

U.S. PATENT DOCUMENTS 3,714,670 2/1973 Pollack et al. ..... 2/183
4,485,495 12/1984 Lunt ..... 2/195.2

FOREIGN PATENT DOCUMENTS 1054971 2/1954 France ..... 2/195.3
204993 10/1923 United Kingdom ..... 2/183

*Primary Examiner*—Clifford D. Crowder
*Assistant Examiner*—Diana L. Biefeld

[57] ABSTRACT

A cap which is self-adjusting within a predetermined range of hat sizes, includes a crown having a dome and a continuous lower rim formed of a flexible substantially inelastic material. The crown has a front portion and a rear portion together having a fully expanded size corresponding to a maximum size at least as large as a largest hat size within the predetermined range of hat sizes. An elastic strip having a rear portion is attached to the front portion of the rim so that an unstretched rear portion produces an elastic loop. The size of the loop and the front portion of the rim combine to form an unstretched size which is at least as small as a minimum hat size within the predetermined range of hat sizes. The elastic strip has a partially stretched length resulting in a size together with the front rim portion, which corresponds to the maximum size of the lower rim which is at least as large as the largest hat size within the range of hat sizes. A plurality of uniformly spaced stitches connect the rear portion of the elastic strip along the rear portion of the lower rim when the elastic is in its partially stretched condition corresponding to the maximum size at least as large as the maximum hat size within the range of hat sizes so that the rear portion of the lower rim collapses uniformly and expands uniformly with the uniformly stitched elastic strip as the cap automatically adjusts to sizes within the range of hat sizes.

21 Claims, 3 Drawing Sheets

ADJUSTABLE CAP, METHOD AND SYSTEM FOR SIZING CAPS

TECHNICAL FIELD OF THE INVENTION

The present invention relates to an adjustable cap and in particular to a cap of the type having a front sun visor or bill and a method of making a cap and a system for sizing caps.

BACKGROUND OF THE INVENTION

Hats of all types have typically been constructed with substantially circular lower rims which have traditionally been constructed in fixed sizes in increments of $\frac{1}{8}$ of an inch diameter. The diameter measurement is for a fixed circular-shaped lower rim or headband, such that each $\frac{1}{8}$ inch incremental head size corresponds to approximately $\frac{3}{8}$ of an inch circumferential dimension ($\pi \times \frac{1}{8} \approx \frac{3}{8}$). Metric sizes for hats are typically measured in centimeters of circumference, with each centimeter of circumference in increments of 1 centimeter for each hat size. This 1 cm metric measurement corresponds closely to each $\frac{1}{8}$ inch hat size measurement as $\frac{3}{8}$ inch circumference $\approx$1 cm circumference. Thus, for example, a size 7 hat is one with a circumference of approximately 22 inches, which is convertible to approximately 56 centimeters and thus, a size 56 under the metric system. Various manufacturers designate hat sizes as small, medium, large, extra large, or similar general designations. For example, under one system hat sizes were designated as "small," corresponding to standard hat size covering $6\frac{3}{4}$ and $6\frac{7}{8}$ (about 54 cm–55 cm); "medium," covering hat sizes 7 and $7\frac{1}{8}$ (about 60 cm–61 cm); "large," covering hat sizes $7\frac{1}{4}$ to $7\frac{3}{8}$ (about 58 cm–59 cm); and "extra large" covering hat sizes $7\frac{1}{2}$ to $7\frac{5}{8}$ (about 60 cm–61 cm). While the small, medium, large, and extra large designations did not normally provide a reliably good fit, the variations between $\frac{1}{8}$ hat sizes (i.e., about $\frac{3}{8}$ circumference or 1 centimeter circumference sizes) usually provided tolerably repeatable fits when accurately constructed. However, because of variations in actual size compared to the nominal size from one manufacturer to another or from one type of material to another, reliable hat fit was not always available.

In the area of sports caps of the type with sun visors or bills, which is typical of a baseball cap, the overall cost of manufacture did not normally justify the types of precision manufacturing required for reliably making caps in each of the $\frac{1}{8}$ inch diameter (1 cm circumference) incremental sizes. Also, maintaining an inventory of caps in all the various size ranges was often cost-prohibitive. Even the generalized size ranges covered by "small," "medium," "large," and "extra large" designations with each size covering two sizes resulted in a total range of sizes from about $6\frac{3}{4}$ to $7\frac{5}{8}$. Obtaining better fit would have required an inventory of eight (8) separate sizes. Also, in view of the use of caps in sports events, not only by adults by also by youngsters, additional sizes were needed for youth sizes as small as size $6\frac{3}{8}$ (20 inches in circumference or metric size 51 centimeters) for youth and also for large athletic adult men as large as hat size 8 ($25\frac{1}{4}$ inches in circumference or 64 centimeters in metric size). Covering this entire range could have required an inventory of fourteen (14) separate hat sizes.

In order to overcome some of the fitting problems or inventory problems, various types of adjustable caps have been devised. Adjustability has typically been accomplished by forming a cut-out portion or an open window, commonly referred to as an "open back" in the rear of the cap crown. The open back was bridged by an adjustable strap or other mechanism by which the size could be adjusted. For example, a pair of overlapping plastic straps, one formed with multiple, projecting plastic rivets, the other formed with multiple holes so that the hat size could be adjusted by interconnecting the appropriately located projecting rivets and holes. Such caps could be incrementally adjusted or readjusted for different users or for variations in head size which might be due to hair style changes of an individual. Often, the incremental adjustments available for multiple size caps resulted in a cap which was either too loose or too tight. Alternatively, the open back was provided with a short continuously adjustable belt, a short piece of elastic, or a hook and loop material which allowed continuous adjustment in a similar fashion as the overlapping plastic bands with releasable rivets. These arrangements with the adjustable open back hat portion helped to alleviate the inventory problems as just a few crown sizes with adjustable open backs could accommodate substantially the entire range of hat sizes. However, new problems with appearance and fit were created. Adjustment of such a cap to a small hat size produced a large amount of bunching of the crown material at the rear of the cap. The bunching produced an unsightly appearance, particularly at the rear of the hat, and also tended to deform the rounded appearance of the rest of the cap crown. Adjustment of such caps to a large hat size caused the crown material at the rear to be stretched or flattened. The flattening at the rear crown portion similarly also tended to result in a misshapen crown elsewhere. Further, the fit and the appearance were interfered with because the open back sometimes resulted in the wearer's hair sticking out of the window in an undesirable fashion.

SUMMARY OF THE INVENTION

The present invention overcomes many of the drawbacks of the prior art caps by providing an adjustable cap covering a range of hat sizes while providing a uniform, smooth contoured appearance without bulging or flattening at a single location as with prior adjustable size caps. In particular, an inexpensive cap is constructed using inelastic fabric crown material with a lower rim sized to the largest size in a particular range of sizes to be covered. An elastic band is formed having a size corresponding to or slightly smaller than the smallest hat size in the range of sizes to be covered. A portion of the elastic band is attached to a portion of the inelastic rim at a location where the visor will be attached. Typically, a visor is attached at the front of the cap along a portion of the rim corresponding to less than 180° of a generally circular circumference. The elastic band is uniformly stretched to conform to the circumferential distance around a rear portion of the inelastic rim of the cap corresponding to a portion greater than 180° of a generally circular shape circumference. The elastic band is stitched to the rim while in a uniformly stretched condition, so that upon completion of the stitching and upon release of the stretching tension, the inelastic crown material collapses with the elastic band uniformly around the entire rear portion corresponding to greater than 180° of the rim circumference. The cap rim is expandable to any head size between the smallest size of the band to the largest size of the inelastic crown fabric. In this manner, a cap is constructed which provides automatic adjustability to the wearer's actual head size, provides a substantially smooth rounded crown contour regardless of the wearer's head size within the range of adjustability, and provides a hat without an open back.

According to another aspect of the invention, a method of cap construction is disclosed which efficiently and cost-effectively allows self-adjustable caps to be constructed. The steps include: forming a crown of inelastic fabric having a rim size corresponding a largest size within a desired range of sizes; forming an elastic band having an unstretched size corresponding a smallest size (or more preferably to a size smaller than the smallest size) within a desired range of sizes; stretching at least a portion of the elastic band is stretched to match the circumferential distance around a portion of the inelastic rim greater than 180° therearound and stitching the stretched portion of the elastic band to the rim along the corresponding circumferential portion while the elastic is maintained in the stretched condition. Additional steps of: attaching a visor around a portion of the circumference of the inelastic rim less than 180°, which portion is not to be compressed by the elastic band and attaching a sweat band with the elastic portion expanded to allow it to be .compressed by the elastic to the smallest size and to adjustably expand to accommodate the largest size within the desired range of adjustability.

According to another aspect of the invention, a system in which adjustable caps are provided which are substantially uniform in contour and in which one hat construction accommodates a range of three (3) or more nominal hat sizes substantially without any perceivable differences in the contoured appearance when worn by individuals with hat sizes anywhere within the multiple hat size range. In particular, it has been found that an inventory of only five (5) caps constructed with various size ranges according to the present invention, can accommodate eleven (11) or more separate nominal hat sizes. Each separate cap size range overlaps the size range covered by the next smaller or the next larger cap construction. Thus, the system of sizing permitted according to the inventive cap construction results in small inventories of caps having a custom tailored look and uniformly consistent feel for a large range of hat sizes. Also, the cross-over capability of each of the cap construction size ranges increases the chances that an acceptable substitute can be provided either in the next smaller or the next larger cap construction range in the inventory.

BRIEF DESCRIPTION OF THE DRAWINGS

These and other objects, advantages, and benefits of the present invention will be more fully understood with reference to the following detailed description, claims, and drawings in which like numerals represent like elements and in which:

DETAILED DESCRIPTION OF THE DRAWINGS

Description of the Prior Art Cap

Figure 1A:
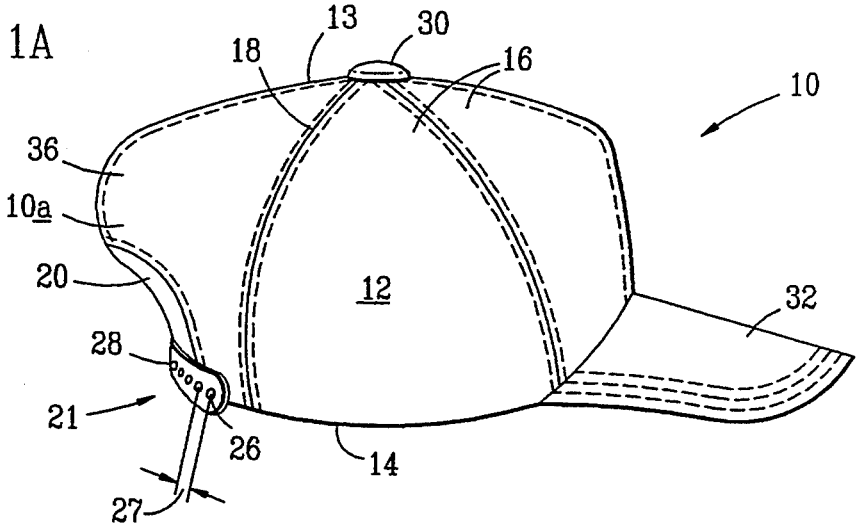
FIG. 1A PRIOR ART
FIG. 1*a* is a side view of a prior art adjustable open back cap adjusted to the small size within a range of adjustability.
Figure 1B:
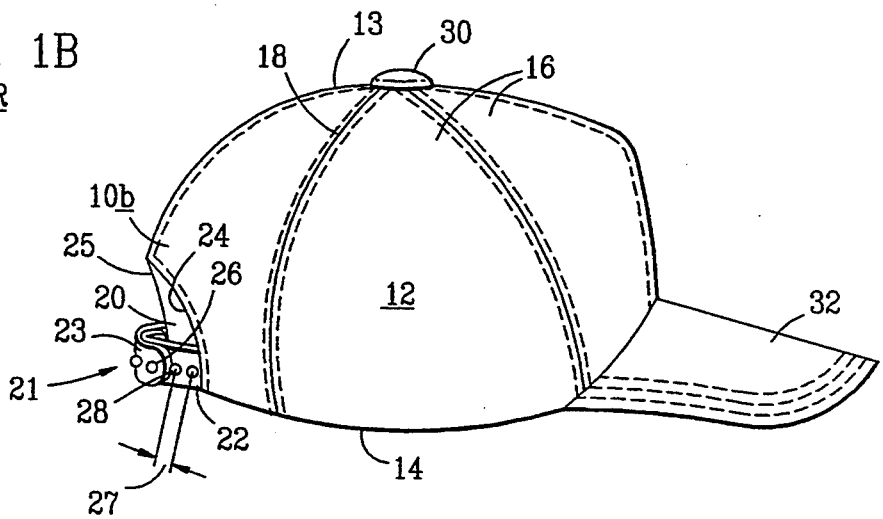
FIG. 1B PRIOR ART
FIG. 1*b* is a side view of a prior art adjustable open back cap adjusted to a size in the middle of the range of adjustability.
Figure 1C:
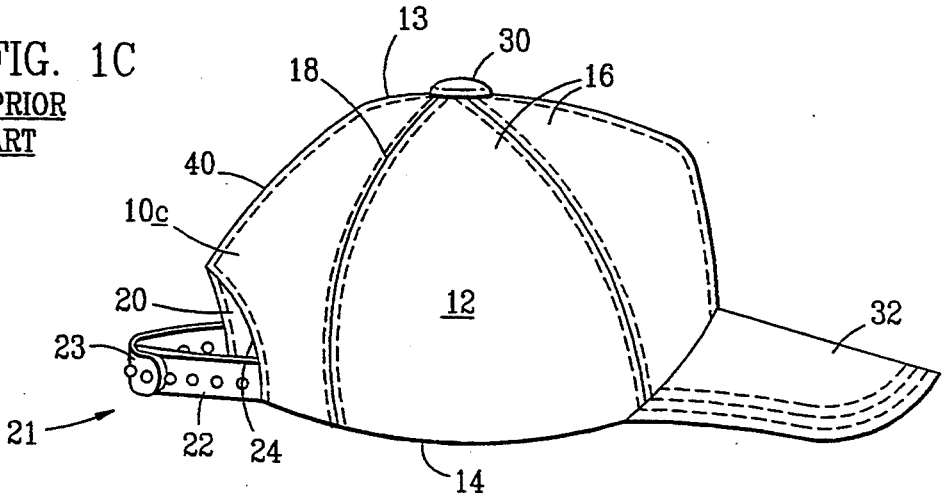
FIG. 1C PRIOR ART
FIG. 1*c* is a side view of a prior art adjustable open back cap adjusted to a large size within the range of adjustability.

An understanding of the present invention will be more fully obtained with reference to FIGS. 1*a*, 1*b*, and 1*c* which are side elevation views of a prior art adjustable cap 10. Each figure shows a different state of adjustment within the available range of adjustability for the cap 10. FIG. 1*a* shows a cap 10*a* adjusted to a small size; FIG. 1*b* shows a cap 10*b* adjusted to a midrange size; and FIG. 1*c* shows a cap 10*c* adjusted to a large size within the range of adjustability. The crown is constructed with a crown 12 having a dome 13 and a lower circumferential rim 14. The dome and lower rim of crown 12 are formed of a plurality of panels 16 which are cut from fabric and which panels 16 are sewn together along panel seams 18. In order to provide adjustability, an open back portion 20, sometimes referred to as a window 20, is formed at the rear of rim 14 and partially up into dome 13 of crown 12. The open back 20 extends around the rim 14 a distance corresponding to an amount greater than the total desired circumferential size adjustment of the cap. An adjustment means 21 has portions 22 and 23 connected to the opposed edges 24 and 25 of open back 20. Portions 22 and 23 are connected or are connectable to each other between the edges 24 and 25 of open back 20 to allow adjustment of the length between edges 24 and 25. The adjustment means 21 extend aligned with lower rim 14 across open back 20. Typically, a button 30 is centrally located on top of dome 13 and a visor 32 or bill 32 is secured projecting substantially laterally from the front of crown 12 along a portion of rim 14 corresponding to less than 180° of the circumference of the rim.

In the specific prior art construction shown, adjustment means 21 includes two mating connectable :plastic straps form portions 22 and 23 which are connectable at different sizes or lengths as through a plurality of holes 26, which are spaced apart a distance 27 corresponding to the incremental adjustable circumference distance, and a corresponding plurality of plastic rivets 28 which are engageable with holes 26 and which are correspondingly spaced a distance 27, which corresponds to the incremental circumferential adjustment size for the adjustable cap. Other constructions of means for adjustment 21 may be used to extend across open back 20, but in any event the resulting effect to the cap crown upon adjustment is substantially similar as will be discussed more fully below.

When a prior art cap 10*a* is adjusted to the small size as indicated in FIG. 1*a*, a bunching 36 or pooching 36 results in a rear portion of crown 12. The bunching at 36 can result in deformation of crown 13 at locations other than the rear as shown, sometimes unpredictably collapsing the crown at some portions and raising it at others.

With specific reference to FIG. 1*b*, in which a middle sized adjustment is depicted for a prior art cap 10*b*, the cap may have a substantially smooth contour. Nevertheless, the open back 20 may allow the wearer's hair to stick out and may cause unwanted matting and a shaggy hair appearance even after the cap is removed.

With specific reference to FIG. 1*c*, in which a large size adjustment is depicted for a prior art cap 10*c*, the adjustment means 21 extends beyond the normal contour of dome 13, such that a flat contour 40 is often produced at the rear of crown 12. This flattening and stretching of the portion of dome 13 adjacent to the open back 20 and can also cause a mal-shaped crown dome 13 in unpredictable areas at the sides, on the top, or even in the front of the cap. The extended adjustment means 21 also expands the opening of open back 20 so that problems with hair sticking out and production of a shaggy appearance is exacerbated.

Description of the Preferred Embodiments of the Invention

Figure 2A:
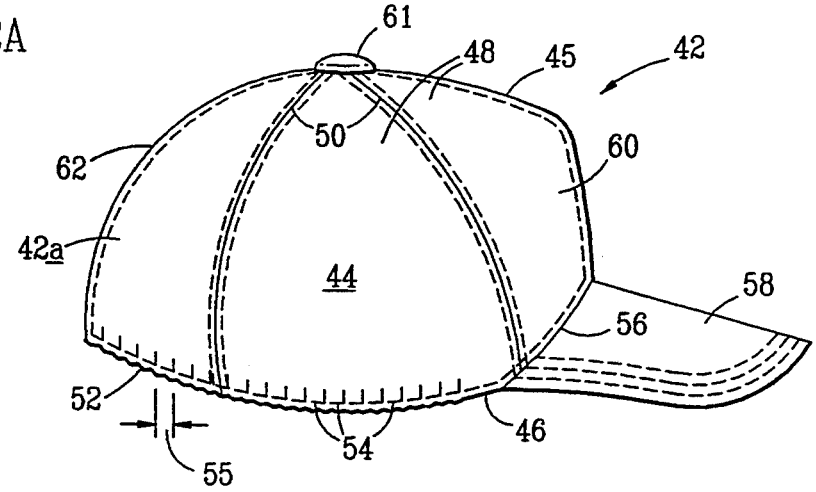
FIG. 2*a* is a view of an adjustable cap according to the present invention adjusted to a small size within a range of adjustability.
Figure 2B:
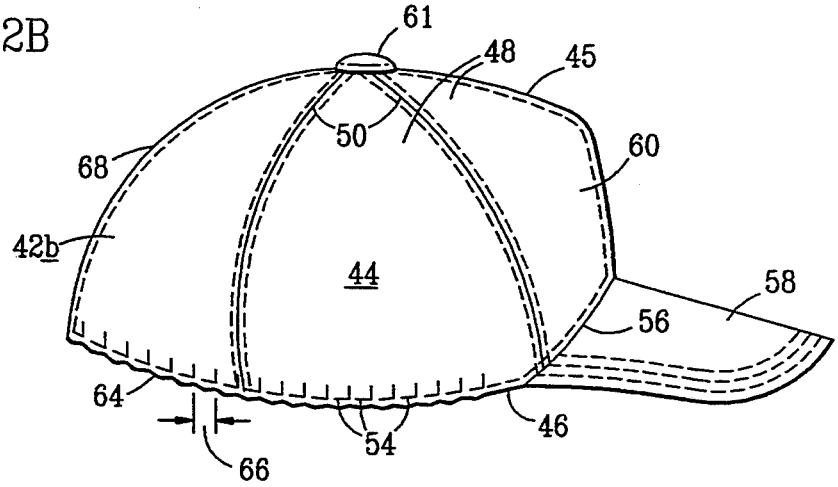
FIG. 2*b* is a view of an adjustable cap according to the present invention adjusted to a size in the middle of a range of adjustability.
Figure 2C:
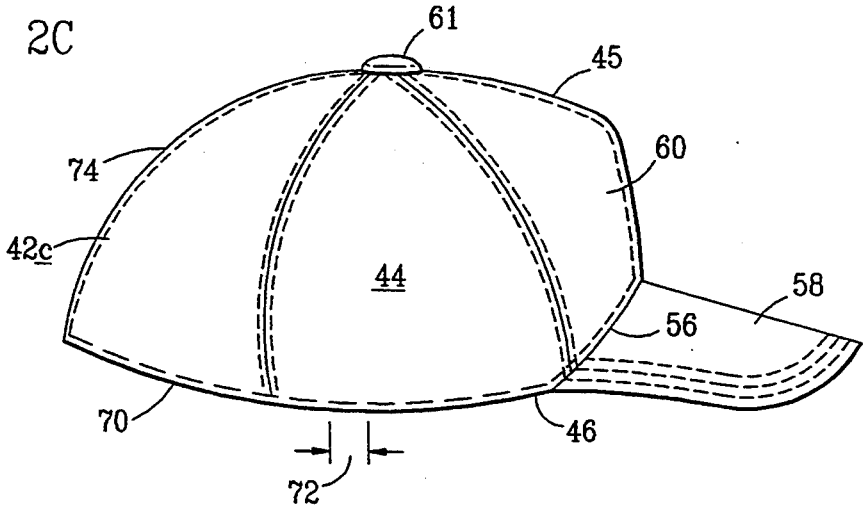
FIG. 2*c* is a view of an adjustable cap according to the present invention adjusted to a large size within a range of adjustability.

FIGS. 2*a*, 2*b* and 2*c* depict an adjustable a cap 42 according to the present invention in a variety of size adjustment conditions within a range of adjustability of the cap 42. FIG. 2*a* shows a small size adjustment designated cap 42*a*; FIG. 2*b* depicts a middle size adjustment designated cap 42*b*; and FIG. 2*c* depicts a large size adjustment designated cap 42*c*, all within the range of adjustability of the inventive self-adjusting cap 42 from a single construction size. The cap 42 has a crown 44 with a lower rim 46 formed with a plurality of panels 48 interconnected along panel seams 50. In a preferred embodiment, the lower rim 46 is advantageously constructed so that it is continuous entirely around the circumference of the crown 44. The panels 48 are constructed of substantially inelastic, yet flexible fabric, such as canvas, cloth, nylon, plastic mesh material, or other typical cap-making fabrics or materials. Lower rim 46 on small size cap 42*a* is shown substantially evenly compressed around a portion 52 of lower rim 46, which portion 52 corresponds to maximum compression or minimum stretch of rim 46. The total compression around portion 52 is made substantially uniform and occurs without bunching at any point with substantially the same amount of compression spacing 55 occurring between each individual stitch 54. Stitches 54 are uniformly spaced around portion 52 of rim 46 during construction. The stitches 54 uniformly compress and uniformly stretch during adjustment after the construction is completed. Preferably, a line of stitches 54 is produced around the rim to attach an elastic strip 82 (shown in FIGS. 3, 4 and 5 below). During construction of manufacturing, the elastic strip 82 is uniquely and advantageously attached to rim 46 when the portion 52 of lower rim 46 is fully stretched to its maximum circumferential size. Thus, the spacing between individual stitch 54 is a maximum distance when band 82 is originally attached to rim 46. Subsequently, when stretching tension is released, the elastic strip 82 collapses and compresses stitches 54 uniformly around portion 52 of rim 46.

A visor 58 is connected around a portion 56 of rim 46 which is not compressed during adjustment. Preferably, portion 56 is at the designated front of the cap so that the compression portion 52 is toward the rear. Preferably, a sizing area 60 is also produced in the front portion corresponding to a circumferential portion 56 of the rim 46 which is less than 180°. The sizing area 60 extends up the dome 45 of crown 44 to give a smooth contoured shape to the cap. Uniform compression around the rim at the rear of the cap does not adversely affect the smooth contour at the front or at the back. A top button 61 is also typically attached centrally located at the upper intersection of a plurality of panels 48 and panel seams 50, which form crown 44.

Because of the uniform compression around the entire rim portion 52, a smooth rear contour 62 results even when the cap 42*a* is compressed to a small size within the range of adjustability. Preferably, the compression portion 52 covers a portion of the circumference which is greater than 180°, so that the compression is advantageously spread over a substantial length and the shape of the cap is maintained.

FIG. 2*b* depicts a middle size adjustment designated cap 42*b*. A middle size evenly compressed rim portion 64 results substantially automatically by placing the cap on a wearer's head having a hat size somewhere in the middle of the adjustability range. The evenly compressed portion 64 of rim 46 results from medium compression of a plurality of stitches 54 substantially evenly compressed entirely around the portion 64 of rim 46. This corresponds to medium compression spacing 66. Because the outward tension on the rim 46 of cap 42*b* is substantially the same in all directions when placed on a wearer's head of a corresponding middle size, the spacing 66 between each of the stitches 54 is substantially equal. No bunching results because the elastic material is uniquely stitched to the rim with the same original stitch spacing and the same thread tension all the way around the rim portion 64. The elastic and the rim stitched together with both in a fully stretched condition. Again, a smooth rear contour 68 results. No open back, cut-out, window, gap or opening of any kind exists at the rear of the cap.

FIG. 2*c* is a depiction of a cap designated 42*c*, which is adjusted to a large size within the range of adjustability. A large size stretched portion 70 of rim 46 is automatically produced by placing the cap on a wearer's head which has a large size within the range of adjustability. Again, a line of a plurality of evenly formed stitches 54 with evenly stretched stitch spacing 72 extends around large rim portion 70. Originally during construction, the stitches 54 are made around portion 52 of the rim 46 when it is stretched to its maximum size. The plurality of panels 48 are originally cut and sewn so that crown 44 has a lower rim 46 which is sized for the maximum or largest size within the range of adjustability. Thus, expanded portion 70 results in a rear contour at 74, which, although slightly larger than middle contour 68 and larger than small contour 62 of FIGS. 2*b* and 2*a*, respectively, is nevertheless a substantially smooth rounded contour without flattening which might be typical of prior art adjustable caps.

Figure 3:
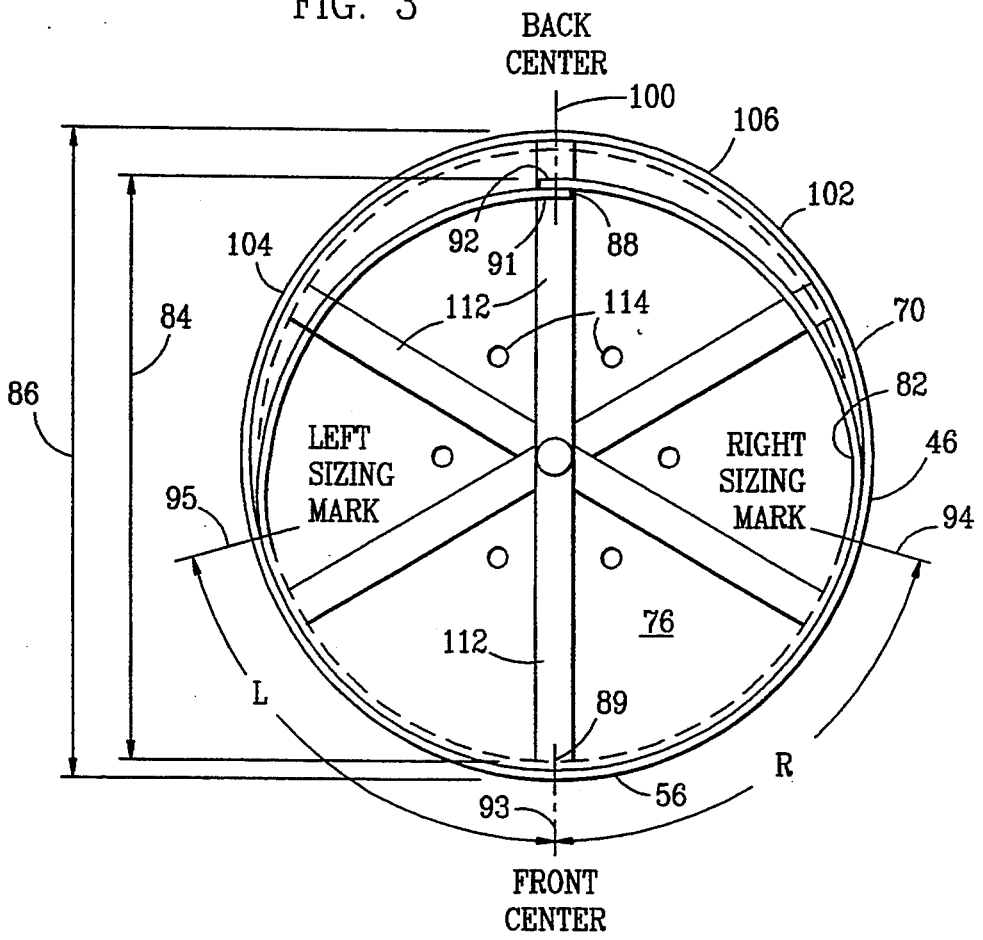
FIG. 3 is a bottom schematic view of the construction of a crown portion of a cap according to the present invention in which an elastic band is shown in phantom lines prior to stretching it and sewing it to the rim of the crown and is shown in solid lines attached in a stretched condition while it is being attached to the rim of the crown.

The structure and method of construction of the inventive cap 42 as depicted in FIGS. 2*a*, 2*b* and 2*c* is demonstrated schematically in the bottom plan view depicted in FIG. 3. The inside 76 of crown dome 45 is shown with a substantially circular bottom lower rim 46. An elastic strip 82 is attached to an unstretched loop shown in both solid lines at a minimum hat size diameter 84 and in phantom lines attached to rim 46 around portion 52 at a maximum hat size diameter 86. The elastic strip 82 is preferably formed of approximately ½ inch wide by 1/32 of an inch thick elastic strip material. Preferably, the strip 82 is formed into a continuous band 83. The unstretched length of the strip of elastic 82 from which band 83 is formed corresponds to the circumference for a minimum hat size, plus any desired length for overlapping at the ends 91 and 92 and stitching the band 83 together as at 88. The elastic band 83 will be stretched to its maximum hat diameter 86 corresponding to the interior of the rim 46 at the time of stitching. As will be discussed more fully below, the elastic is expanded a uniform amount entirely around a rear portion 70 corresponding to the largest size of a fully stretched rim portion 46 at the time of stitching.

Preferably, the elastic band 83 is formed of a single strip 82 of elastic material stitched end 91 to end 92 with an overlap at 88. A center of the strip is noted and may be marked at 89 equidistant from each overlapped end 90 and 92. The center 89 of the strip 82 from which the elastic band 83 is formed is thus diametrically opposite the, stitched area 88. In the preferred method of construction, this center point 89 is tacked, as with one or two stitches, to a designated front center point 93 of the lower rim 46. A sizing mark 94 and another sizing mark 95, corresponding to the sizing area for the front portion 56 of the cap dome 45, are noted and may be marked on either side of front center point 93. As is typical in most caps, this sizing area is less than 180° of the entire circumference of lower rim 46. Elastic band 82 is stitched without stretching from sizing edge 94 to sizing edge 95 entirely around the combined front portion 56. As indicated previously, no compression will result from the unstretched stitching of elastic band 83 along this front portion 56 of rim 46 which is preferably less than 180° of the entire circumference. The elastic band 83 is advantageously attached in this area so that a uniform thickness rim is provided; but, the elastic band is not stretched prior to stitching so that at the front of the cap there is no compression or bunching, even in the small minimal manner which would result in the rear of the cap. The portion of the elastic band 83 along the front portion provides part of the internal size strip interposed between the wearer's head and the front of the cap. This is the same portion along which the substantially rigid visor 58 will be attached and the additional material conveniently serves to provide additional cushioning in this area.

The remaining portion of elastic band 83 is then stretched to conform to the length of the circumference of the large size portion 70 of rim 46 expanded to its maximum size. Because the remaining portion 70 of rim 46 is preferably greater than 180° circumference, a unique and preferred method of construction has been developed by which uniform stretching of the elastic can be accomplished and maintained until stitching between the circumference of rim 46 and elastic band 83 can be completed. The point at 88 where the ends of elastic band 83 are overlapped and stitched together is preferably tacked to rear center 100 of rim 46. A first portion 102 of the adjustable stretched portion 70 is stretched out straight with the corresponding portion of elastic band 83 stretched therealong. The elastic band and the rim are stitched together from the sizing mark 94 entirely around the portion 102 until reaching the rear center 100. Next, the other portion 104 of the stretched portion 70 is extended in a straight manner with the corresponding portion of elastic band 83 stretched to conform to the length of portion 104. The elastic band 83 and rim 46 are stitched together with the same stitch spacing and the same tension as was used for the portion 102. Thus, a combined length 106 of uniformly stretched elastic stitched together results corresponding to the large size stretch rim portion 70 of FIG. 2*c*. While it will be understood that the advantage of uniform compression around rear portion 70 could be obtained with a shorter strip 82 of elastic attached securely at sizing marks 94 and 95 and uniformly stretched only from sizing mark 94 to sizing mark 95 around the rear portion 106 of rim 46, this construction is not the most preferred for the reasons as forth above.

A sweat band 108 (shown in FIGS. 4 and 5) is preferably fastened inside of the rim 46, overlapping and sandwiching the elastic band 83 between sweat band 108 and lower rim 46. Preferably, the sweat band 108 will also be attached in a manner so that the elastic strip 82 or band 83 is in a stretched condition around the entire combined elastic portion 106 while sweat band 108 is being attached. The visor 58 is then attached at 56 where no stretching or compression is to occur. A plurality of tape strips 112 overlapping dome and panel seams 50 successfully covers any rough edges and produces a finished product look without excessive weight or heat retention characteristics. Vents or eyelets 114 can also be formed in order to produce a light and airy well-ventilated cap, if desired.

Figure 4:
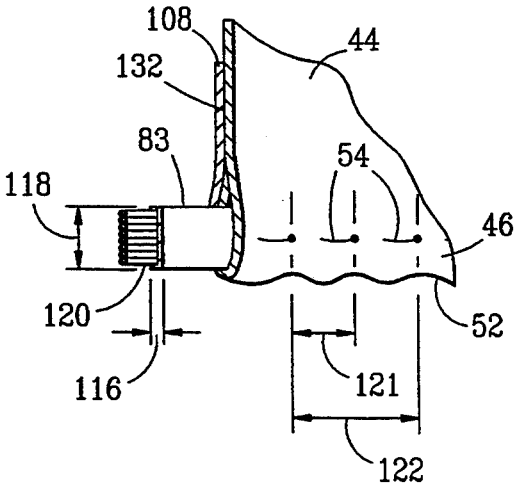
FIG. 4 is a partial cut-away perspective view of a portion of a portion of the rim constructed according to the present invention, which portion is shown elastically compressed.
Figure 5:
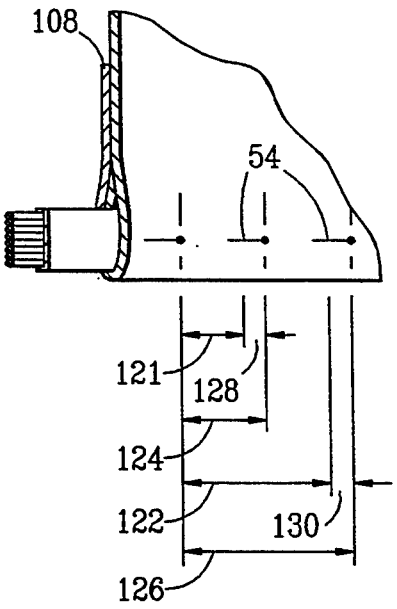
FIG. 5 is a partial cut-away perspective view of the rim portion of FIG. 4 shown in an expanded or stretched condition according to the present invention.

With reference to FIG. 4, which is a partial cut-away view of the construction of the compressible rim portion of the cap, shows the resulting structure with a fixed number of individual stitches 54 shown in a compressed condition similar to that as would result at compressed rim portion 52 as shown in FIG. 2*a*. Again, the dimensions of the elastic is preferably sufficiently thin at 116 to allow it to be conveniently fitted around the rim 46. A thickness of about 1/32 of an inch has been found to work well. A width 118 sufficient to provide a uniformly distributed compression force is also preferred. A width 118 of about ½ of an inch has been found to work well. An elastic strip material having about eight (8) to about sixteen (16) strands of rubber 120 interposed linearly therealong has also been found to provide a desirable amount of tension. Additional strands 120 corresponding to a larger thickness 118 can provide additional tension for providing a cap with a tighter fit. A lesser number can produce a cap with a looser fit. Also, increasing the size of strands 120 or increasing any of the dimensions 116 or 118 can also result in an elastic material which has greater compression force. However, it has been found that the resilient force in an elastic band 83 having dimensions of about ½ inch in width and about 1/32 of an inch thickness with about eight (8) to sixteen (16) strands of rubber 120, will produce a comfortable amount of compression for most cap wearers.

The uniform compression distance 121 between each of the stitches 54 is also depicted in FIG. 4 so that the overall length 122 for a given number of stitches 54 is slightly less than the overall length of the same number of stitches 54 when originally formed. This relationship is more clearly understood with reference also to FIG.

5 which is a partial cut-away view corresponding to the portion shown in FIG. 4, but in an expanded condition. The initial stretched spacing 124 between each of the stitches 54 is depicted and the initial overall length 126 is slightly larger than the compressed length 122. The small incremental differences 128 for each of the stitches 54 combine for a given number of stitches 54 to give the total difference 130 between compressed length 122 and stretched length 126.

In the preferred method of stitching, the stitches 54 are maintained at a rate of about 8 to about 10 stitches per inch (i.e., initial spacing 124 of about $\frac{1}{8}$ to about 1/10 of an inch spacing for each stitch). Also, while either chain stitches or lock stitches could be used circumferentially around the rim of a cap during construction, it has been found that lock stitches are preferred for the present invention because of their better expandability. Those skilled in the art will understand that where bobbin tension on a sewing machine is too tight, bunching of the material will result during sewing and the machine will not work properly. Similarly, a bobbin which is too loose will not work properly. It has been found that standard operating bobbin tension for most production sewing machines when using a lock stitch will result in substantially uniform compressibility for a cap constructed as described above according to the present invention.

A preferred system of sizing according to the present invention, provides designated adjustable sizes including "youth," "small," "medium," "large," and "extra large" as indicated in Table 1 below. The indicated range of adjustability is given in terms of standard hat sizes in $\frac{1}{8}$" diameter increments for which the designated size is designed to fit. The preferred circumferential sizes for both an elastic band and for a sewn cap rim before adding an elastic band or a sweat band are also set out in Table 1. This system provides a complete inventory of caps covering eleven (11) separate standard hat sizes, with overlapping sizes between each adjacent larger or smaller hat size.

TABLE 1

| SIZE | DESIGNED TO FIT | MINIMUM ELASTIC BAND CIRCUMFERENCE | MAXIMUM CAP RIM CIRCUMFERENCE |
|---|---|---|---|
| Youth | $6\frac{5}{8}$, $6\frac{3}{4}$, $6\frac{7}{8}$ | $19\frac{1}{2}$ | |
| Small | $6\frac{7}{8}$, 7, $7\frac{1}{8}$ | 21 | $23\frac{1}{4}$ |
| Medium | $7\frac{1}{8}$, $7\frac{1}{4}$, $7\frac{3}{8}$ | $21\frac{7}{8}$ | $24\frac{1}{4}$ |
| Large | $7\frac{3}{8}$, $7\frac{1}{2}$, $7\frac{5}{8}$ | $22\frac{3}{4}$ | $23\frac{3}{4}$ |
| X Large | $7\frac{5}{8}$, $7\frac{3}{4}$, $7\frac{7}{8}$ | $23\frac{5}{8}$ | $25\frac{5}{8}$ |

It will be seen that in each instance for each adjustable size designation, the minimum elastic band circumference is between about 0 and $1\frac{1}{2}$ inches smaller than the circumferential measurement corresponding to the smallest standard hat size within the range of adjustability. In the preferred embodiment, the youth hat size will be constructed with a minimum elastic band circumference which is substantially smaller than the smallest hat size within the range of adjustability so that youth hats are capable of adjusting to sizes even smaller than the smallest size in the range of adjustability. The tighter fit is not normally objectionable to young cap wearers. On the other end of the size spectrum, large and extra large sizes are constructed with minimum elastic band circumferences which are only slightly smaller than the smallest size within the range of adjustability. Preferably, the minimum elastic circumference is about one hat size smaller than the smallest hat size in the range of adjustability so that the fit is sufficiently snug without being uncomfortable in the larger sizes.

The maximum cap rim circumference is preferably between about 0 and $1\frac{1}{2}$ inches larger in circumference than the circumference of the largest hat size within the range of adjustability. The maximum cap rim circumference is preferably consistently about 1 inch larger than the maximum circumference of the largest size within each range of adjustability so that upon completion of the cap, including sewing together the elastic band, the overlapped rim and the sweat band, the overall circumference inside the cap is reduced by about $\frac{5}{8}$ of an inch in circumference. Thus, the cap, when finished, has about one standard hat size expansion clearance beyond the largest size in the "Designed to Fit" range of adjustability, which allows easy placement on a wearer's head having the largest hat size within the range of adjustability.

It will be understood also from viewing Table 1 that those desiring a looser fit with less elastic tension around their crown may move to the next larger designated adjustable hat size and those desiring a tighter fit may move to the next smaller hat size. The preferred minimum elastic circumference and the preferred maximum cap size as described and set forth in Table 1, allow significant size overlapping without sacrificing smooth contoured shape and fit normally only associated with custom tailored hats or caps.

Thus, a complete system of sizing for adjustable caps is uniquely provided which accommodates the needs and desires of a wide range of individuals with varying hat sizes and also individuals desiring varying types of fit, i.e., tight or loose fit, while requiring an inventory of only five (5) designated adjustable cap sizes.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A cap which is self-adjusting within a predetermined range of hat sizes, said cap comprising:

(a) a crown having a dome and a continuous lower rim formed of a flexible substantially inelastic material and with a front portion and a rear portion together having a fully expanded size corresponding to a maximum size at least as large as a largest hat size within said range of hat sizes;

(b) an elastic strip having a rear portion, which elastic strip is attached to said front portion of said rim so that said rear portion results in an unstretched hat size together with said front portion of said rim, which unstretched hat size is at least as small as a minimum hat size within said predetermined range of hat sizes and said elastic strip having a partially stretched condition resulting in a stretched size together with said front rim portion, which stretched size corresponds to said maximum size of said lower rim which is at least as large as said largest hat size within said range of hat sizes; and (c) a plurality of uniformly spaced stitches connecting said rear portion of elastic strip in said partially stretched condition along said rear portion of said lower rim, which partially stretched condition of said elastic strip corresponds to said maximum size of said lower rim which is at least as large as said maximum hat size within said range of hat sizes so that said rear portion of said lower rim collapses uniformly with said partially stretched and uniformly stitched rear portion of said elastic strip as said elastic strip returns to its unstretched size at least as small as said minimum hat size within said range of hat sizes.

2. A cap as in claim 1 wherein said rear portion of said rim comprises more than 180° and said front portion of said rim comprises less than 180° of the total rim.

3. A cap which is self-adjusting within a predetermined range of hat sizes, said cap comprising:

(a) a crown having a dome and a lower rim formed of a flexible substantially inelastic material having a fully expanded size corresponding to a maximum hat size within said range of hat sizes;

(b) an elastic strip formed in a continuous band having an unstretched condition resulting in a size corresponding to a minimum hat size within said predetermined range of hat sizes and having a partially stretched condition resulting in a size corresponding to said maximum hat size within said range of hat sizes;

(c) a first plurality of uniformly spaced stitches connecting said elastic band at a front portion of said lower rim in its unstretched condition; and (d) a second plurality of uniformly spaced stitches connecting said elastic band along a rear portion of said lower rim in its partially stretched condition corresponding to said maximum hat size within said range of hat sizes so that said rear portion of said lower rim collapses uniformly with said elastic as said elastic returns to its unstretched condition corresponding to said smallest hat size within said range of adjustability.

4. A cap which is self-adjusting within a predetermined range of hat sizes as in claim 3 further comprising a visor attached to said front portion of said lower rim corresponding to said first plurality of uniformly spaced stitches at which said elastic band is attached in its unstretched condition.

5. A self-adjusting cap as in claim 4 wherein said adjustable range of circumferential dimensions between said minimum hat size and said maximum hat size within said range of adjustability spans greater than about ¾ of an inch and less than about 2 inches of circumference.

6. A self-adjusting cap as in claim 3 wherein said crown having a dome and a lower rim comprises a plurality of continuous panels of flexible inelastic material sewn together along seams such that said dome and lower rim are substantially continuously interconnected so that no open area exists.

7. A self-adjusting cap as in claim 3 further comprising a sweat band sized corresponding to the largest hat size within the range of adjustability, which sweat band is stitched substantially continuously around the lower rim portion inside said crown overlapping said elastic band with said elastic band stretched to said largest size so that said sweat band collapses and expands with said elastic when tension is released or reapplied.

8. A self-adjusting cap as in claim 3 wherein said elastic band comprises a strip of elastic having a thickness of about 1/32 of an inch and a width of about ½ of an inch.

9. A self-adjusting cap as in claim 3 wherein said adjustable range of circumferential dimension between said minimum hat size and said maximum hat size within said adjustable range spans greater than about ¾ of an inch and less than about 3 inches of circumference.

10. A self-adjusting cap as in claim 3 wherein said range of adjustable hat sizes between said minimum hat size and said maximum hat size spans greater than about ¾ of an inch and less than about 1½ inches of circumference.

11. A self-adjusting cap as in claim 3 wherein said range of adjustable hat sizes between said maximum hat size and said minimum hat size spans about 1⅛ inches of circumference covering a range of about three standard ⅛ inch diameter hat sizes.

12. A self-adjusting cap as in claim 3 wherein said elastic strip is attached to said lower rim with sewn stitches evenly spaced circumferentially therearound when said elastic and lower rim are stretched to the maximum hat size.

13. A self-adjusting cap as in claim 12 wherein said evenly spaced stitching circumferentially around said lower rim comprise stitches having a spacing determined by a stitching rate of between about 8 and 10 stitches per inch.

14. A self-adjusting cap as in claim 13 wherein said stitches comprise lock stitches.

15. A method of forming a self-adjusting cap comprising the steps of:

(a) cutting panels for forming a cap crown, including a substantially continuous lower rim portion having a size corresponding to a maximum hat size within a range of desired adjustability, which rim is continuous with a dome portion;

(b) sewing said panels together along panel seams;

(c) cutting a strip of elastic at a first predetermined length in an unstretched condition;

(d) attaching said elastic strip at least at each side of a front portion of said rim so that a rear portion of said elastic strip remains unstitched;

(e) stretching said rear portion of said elastic strip to correspond to a maximum hat size around a rear portion of said rim; and (f) stitching said stretched rear portion of said elastic strip to said rear portion of said lower rim, while said rear portion of said elastic strip is in a stretched condition, with evenly spaced stitches in a circumferential direction.

16. A method of forming a self-adjusting cap as in claim 15, wherein said stretched portion of said elastic strip and said rear portion of said lower rim to which said stretched portion of said elastic is stitched comprises more than 180° of the circumference of said lower rim and said portion of said lower rim at which said elastic strip is attached in an unstretched condition comprises less than 180° of the circumference.

17. A method of forming a self-adjusting cap as in claim 16, wherein the step of attaching the elastic strip comprises stitching the elastic strip with evenly spaced stitches at a rate of about 8 to 10 stitches per inch.

18. A method of forming a self-adjusting cap as in claim 15 further comprising the steps of:

(a) cutting said elastic strip in a predetermined length corresponding to a circumference of a circle corresponding to a minimum hat size within a range of adjustability, plus a short distance for an overlap;

(b) sewing overlapped ends of said strip together to form a continuous elastic band having a diameter corresponding to said minimum hat size within said range of adjustability;

(c) sewing a front portion of said elastic around said front portion of said lower rim without stretching said elastic;

(d) stretching the remainder of said elastic band to conform to said rear rim portion; and (e) stitching said stretched remainder of said elastic band to said rear rim portion while said remainder of said elastic band is maintained in a stretched condition with said evenly spaced stitches in a circumferential direction at least partially around said lower rim along said rear rim portion.

19. A method of forming a self-adjusting cap as in claim 18, wherein said stretched portion of said elastic band and rear portion of said lower rim to which said stretched portion is stitched comprises more than 180° of the circumference of said lower rim and said front portion of said rim at which said elastic band is attached in an unstretched condition comprises less than 180° of the circumference.

20. A method of forming a self-adjusting cap as in claim 18, wherein said step of stitching said stretched elastic to said expanded rim comprises the step of continuously forming uniformly spaced lock stitches at a rate of 8 to 10 stitches per inch around the rear portion of the rim.

21. A method of forming a self-adjusting cap as in claim 18, wherein said step of forming said band of elastic strip comprises forming a band having a diameter corresponding to a hat size three hat sizes smaller than the maximum diameter of the rim formed with said cut and sewn panels.

* * * * *